US005300923A

United States Patent [19]

Gruber

[11] Patent Number: 5,300,923

[45] Date of Patent: Apr. 5, 1994

[54] APPARATUS AND METHOD FOR DISABLING A SMOKE DETECTOR WHEN USING A SMOKE-EMANATING APPARATUS

[76] Inventor: Ralph W. Gruber, P.O. Box 1977, Cave Creek, Ariz. 85331

[21] Appl. No.: 855,779

[22] Filed: Mar. 23, 1992

[51] Int. Cl.[5] ..... G08B 17/10

[52] U.S. Cl. ..... 340/628; 340/632; 126/299 R

[58] Field of Search ..... 340/628, 632; 126/299 R, 299 D, 299 F

[56] References Cited

U.S. PATENT DOCUMENTS

| | | | |
|---|---|---|---|
| 4,313,110 | 1/1982 | Subulak et al. | 340/628 |
| 4,567,477 | 1/1986 | Cormier | 340/628 |
| 4,600,314 | 7/1986 | Theriault | 340/628 |
| 4,659,909 | 4/1987 | Knutson | 340/628 |
| 4,827,244 | 5/1989 | Bellavia et al. | 340/514 |
| 4,901,056 | 2/1990 | Bellavia et al. | 340/514 |
| 5,186,653 | 2/1993 | Robert | 340/628 |

*Primary Examiner*—John K. Peng
*Assistant Examiner*—Edward Lefkowitz
*Attorney, Agent, or Firm*—Harry M. Weiss

[57] ABSTRACT

An apparatus and method for use with a smoke detector that is located in proximity with a stove or similar smoke-emanating article. The smoke detector is enabled by placing the detector near the stove (or similar article) and/or applying a source of power to the smoke detector. The smoke detector is coupled to a device that operates to alleviate the accumulation of smoke that might emanate from the stove. Such a device might take the form of a stove hood or, specifically, a fan incorporated or associated with the stove hood. The smoke detector is mechanically and/or electrically coupled to the hood so that when the hood or fan is operating, the smoke detector is disabled and no alarm is communicated. The alarm may be automatically interrupted when the hood and/or fan are mutually deployed in an active (ON) mode.

8 Claims, 2 Drawing Sheets

APPARATUS AND METHOD FOR DISABLING A SMOKE DETECTOR WHEN USING A SMOKE-EMANATING APPARATUS

FIELD OF THE INVENTION

The invention relates to automatic alarm systems and, more particularly, to a system for automatically inhibiting the operation of a smoke detector that is located in proximity with a cooking device or other smoke-emanating apparatus. The alarm is inhibited when a fan, or other means for alleviating anticipated accumulation of smoke, is enabled or operating.

BACKGROUND OF THE INVENTION

Smoke detectors have become almost ubiquitous in businesses and residences throughout our country. In many instances they are required by law, regulation, or ordinance. Accordingly, it is irrefutable that smoke detectors play a significant role in preserving life and property. Nevertheless, the subject invention recognizes and addresses a subtle drawback associated with the operation of smoke detectors.

That is to say, a properly maintained and operating smoke detector is prone to communicate its stridently audible alarm when installed in the proximity of a stove or other cooking apparatus. Although installation of a smoke detector in proximity to a stove is desirable in that it leads to the detection of smoke that might occur when the stove is unattended, the smoke detector is, to a degree, superfluous when the stove is attended by a competent individual. Annoyance results when the detector's audible alarm is conveyed in the presence of individuals who are fully apprised of the circumstances surrounding operation of the stove. Rather than requiring tolerance to the disconcerting alarm, which might motivate one to manually disable the smoke detector, the subject invention affords a technique for selectively inhibiting the alarm when, for example, an exhaust fan associated with the stove is caused to operate. It is contemplated that the exhaust fan will be manually enabled by activation of a switch. Activation of the fan switch, for the purposes of this invention, serves as an indication that the stove is attended and that normal operation of the alarm is unnecessary. Furthermore, engagement of the fan presumably results in smoke removal, thereby alleviating the condition which, at least in part, presented justification for communication of the alarm.

Although heretofore known techniques for selectively operating a smoke detector have been suggested, none appears to operate in the manner of the subject invention. For example, U.S. Pat. No. 4,600,314, "Smoke Detector Cut Off Timer", ("Thereault") discloses circuitry that uses a timer to disable a smoke detector for a predetermined length of time. However, although the teachings of Thereault are applicable to the use of smoke detectors in the context of cooking apparatus, Thereault does not suggest use in conjunction with an exhaust fan.

Conversely, U.S. Pat. No. 4,659,909, "Kitchen Range Safety Shutoff", ("Knutson") discloses a technique in which a signal developed by the smoke detector is used to interrupt operation of the stove.

Other art of what appears to be peripheral relevance to the subject invention includes U.S. Pat. No. 4,827,244, "Test Initiation Apparatus with continuous or Pulse Input", and U.S. Pat. No. 4,901,056, (same title).

SUMMARY OF THE INVENTION

The above and other objects, advantages and capabilities are achieved by a method and an apparatus for selectively inhibiting an alarm associated with a smoke-emanating device.

In one aspect, the invention includes a smoke detector for generating an alarm in response to the detection of smoke. A switch associated with the smoke-emanating device is coupled to the smoke detector so that engagement of the switch in a first position enables the smoke detector and engagement of the switch in a second position inhibits the smoke detector.

Another aspect of the invention comprises switch means coupled to a smoke detector and to a smoke-removing apparatus, e.g., an exhaust fan. The switch, which is configured to be coupled to a power source, can be engaged in two positions. In a first position, the switch is configured to couple the power source to the smoke-removing apparatus and not to the smoke detector means, so that the smoke-removing apparatus is inhibited. In the second position, the switch is configured to couple the power source to the smoke detector and not to the smoke removal means, so that the smoke detector is enabled.

A further aspect of the invention includes a method of operating a smoke detector according to which the smoke detector is enabled to detect smoke in the proximity of a device that may be predicted to emanate smoke. When an alarm produced by the smoke detector is observed, a device that alleviates the accumulation of smoke is enabled. As a result of enabling the device, the alarm produced by the smoke detector is automatically, and substantially simultaneously, inhibited.

BRIEF DESCRIPTION OF THE DRAWINGS

FIGS. 1, 2 and 3 illustrate, inter alia, range hood 1, venting conduit 2, fan 3, smoke detector 4, and conductor 5 coupling the smoke detector to a switch 6.

DESCRIPTION OF A PREFERRED EMBODIMENT

For a better understanding of the subject invention, reference is made to the following Description and appended Claims, in conjunction with the above-described Drawings.

Figure 1:
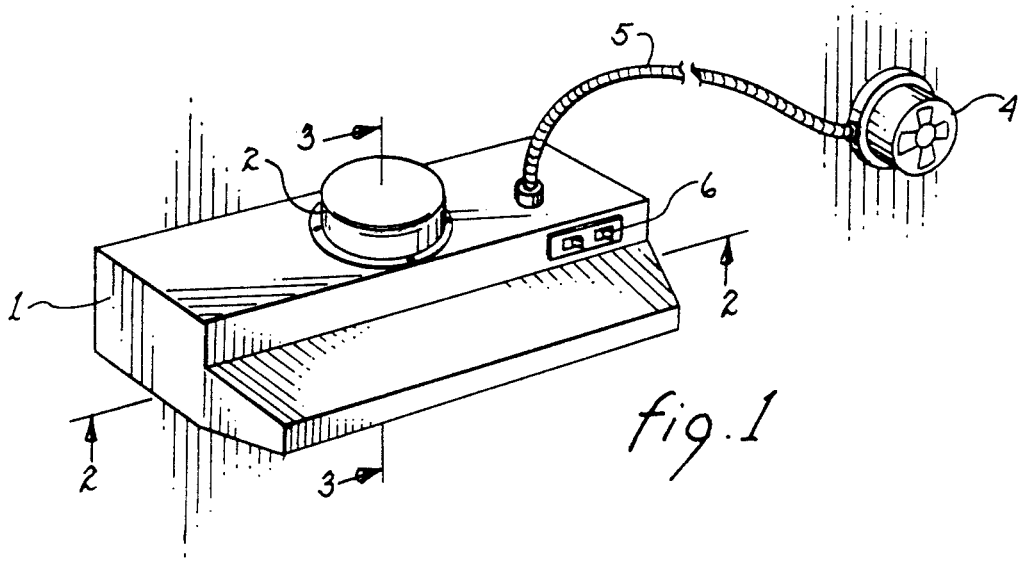
FIGS. 1, 2 and 3 are top, bottom and cross-sectional views, respectively, of a selectively engageable smoke alarm apparatus, as the smoke alarm apparatus might be deployed in the context of use with a stove or similar cooking apparatus.
Figure 2:
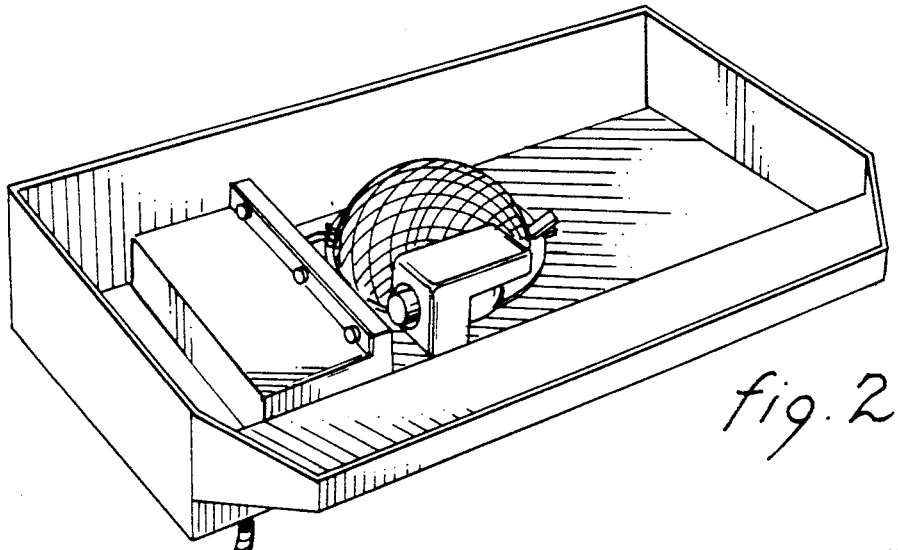
Figure 3:
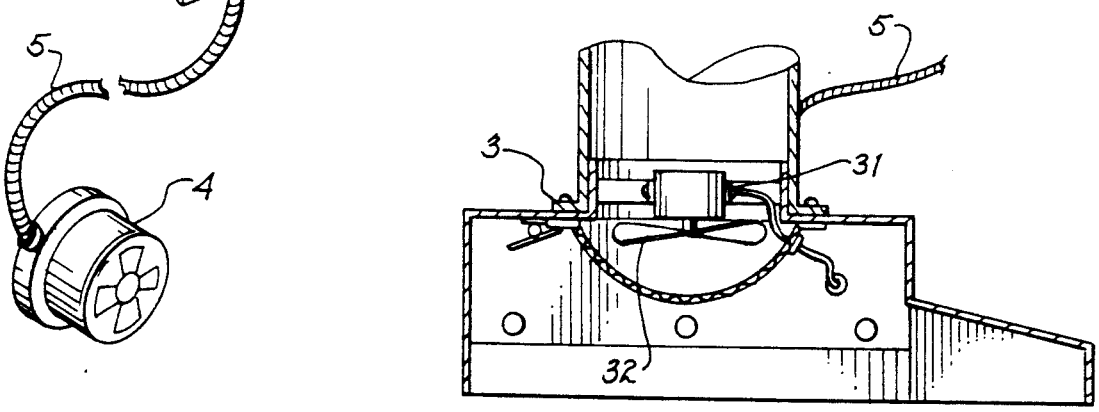

Attention is now directed to FIGS. 1, 2 and 3, collectively. Depicted in those Figures is a generally conventional range hood 1 that includes a venting conduit 2. The venting conduit operates, according to a well-known manner, in conjunction with a fan 3 to remove smoke that might be generated by or otherwise emanate from a stove (not shown) or Other cooking apparatus. In an entirely pedestrian manner, fan 3 is shown to include a motor assembly 31 this is coupled to and drives a set of rotor blades 32. Fan 3 is selectively coupled to a power source (also not shown) through a switch 6. In one position, switch 6 electrically couples the fan (specifically, the fan motor 31) to the Power source so that the fan operates to force air and, if present, smoke up and through conduit 2. When in another position, the fan is decoupled from the power source and is rendered inoperative. Switch 6 may serve other functions in the context of the overall operation of range hood 1. However, those functions are discretionary and are deemed ancillary to the instant invention.

As is not uncommon in a working area such as a kitchen, a smoke detector is provided for use with this cooking apparatus or stove. Such a smoke detector 4 is depicted in FIGS. 1 and 2. The smoke detector will operate to produce an alarm upon detection of smoke. Typically the alarm is a strident audible alarm. While proper operation of such a smoke detector may be generally regarded as a salutary circumstance, this invention addresses occasions, not suggested in the known prior art, when the communication of such an alarm is contraindicated. For example, it is not uncommon that certain types of cooking, or the cooking of certain foods, routinely result in the generation, or emanation of smoke from a stove. When the stove is attended by a competent person, the occurrence of such smoke does not signal a hazardous event. Nevertheless, in accordance with conventional installations, a smoke detector that is installed in proximity with the stove will nonetheless detect smoke and communicate a loud alarm, to the consternation of all, including children and pets in the vicinity. The subject invention circumvents such occurrences in the manner to be described immediately below. The essence of the invention is to couple smoke detector 4, through a conductor 5, to the range hood so that the smoke detector, or more accurately, its associated alarm, is inhibited in response to a condition, manually initiated, that operation of the alarm is contraindicated. As presently contemplated by the invention, the smoke detector alarm is inhibited when the fan 3 is operating. This effect is achieved in the following manner.

Figure 4:
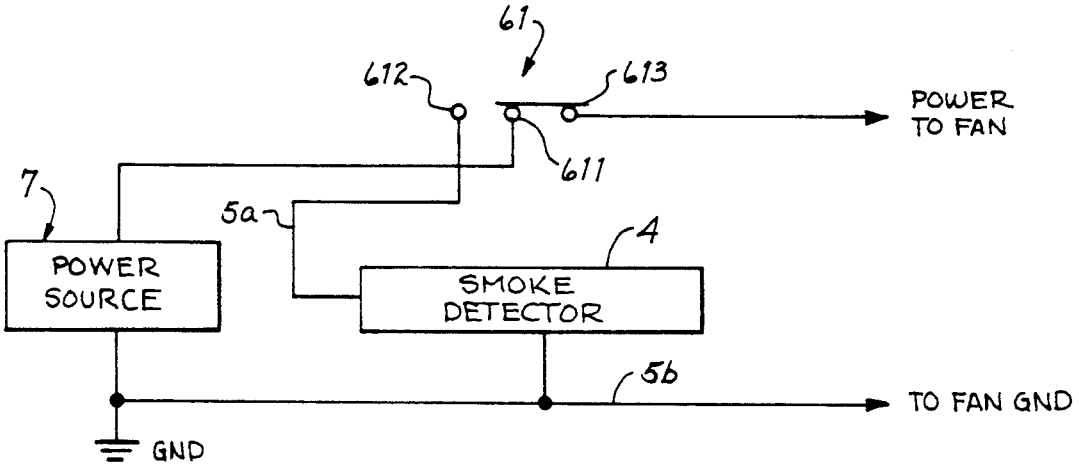
FIG. 4 is a circuit diagram depicting the manner in which the smoke detector 4 is coupled to switch 6 so as to enable the subject invention.

To enable an understanding of the construction and operation of the invention, attention is directed to the circuit diagram of FIG. 4. As depicted in FIG. 4, the invention includes a switch 61—which may, preferably, be part of switch 6 depicted in FIG. 1—that has a contact 611 coupled to a power source 7. The specific nature of power source 7 is not a part of this invention and power source 7 may be selected to satisfy the requirements of the range hood and of the fan and smoke detector. Similarly, given the nature of power source 7 as well as fan 3 and smoke detector 4, switch 6 may be easily selected by those having ordinary skill in the art.

In a first position of switch 61, contact 611, which may be considered the pole of switch 61, is connected to a contact 612. Contact 612 is seen to be coupled to the fan so as to distribute power to the fan to render the fan operable. With pole 611 connected to contact 612, power source 7 is decoupled from smoke detector 4. However, in a second position of switch 61, pole 611 is connected to a contact 613, which is in turn connected to smoke detector 4. In the second position, the power source will be coupled to the smoke detector, but not to the fan. As can be readily appreciated, selective manual engagement of switch 61 determines whether the fan will be enabled or disabled. If the fan is enabled, the smoke detector will be inhibited. Conversely, if the fan is disabled, the smoke detector will be enabled by application of power source 7 through contacts 611 and 613 to the smoke detector.

Figure 5:
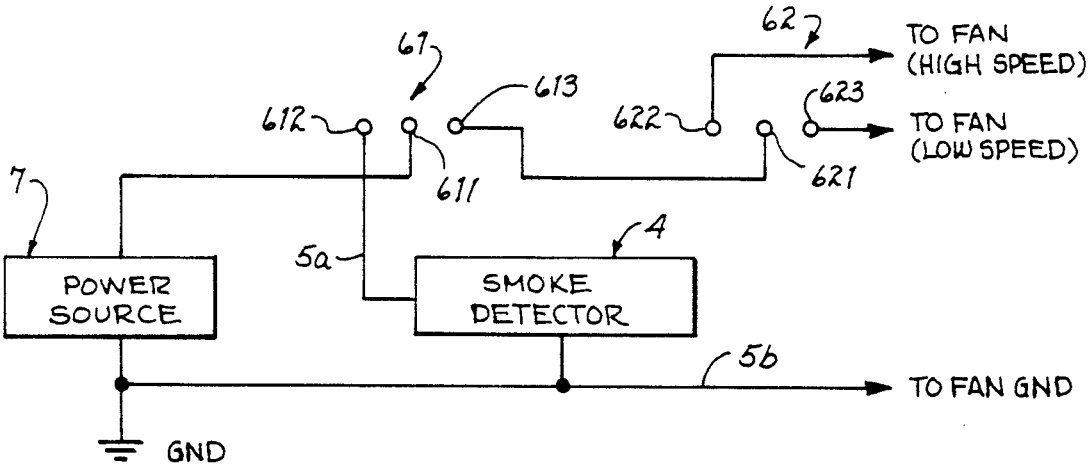
FIG. 5 is a circuit diagram depicting a somewhat more elaborate configuration of the subject invention.

A somewhat more elaborate embodiment of the subject invention is illustrated in FIG. 5. In the configuration of FIG. 5, contact 613 of switch 61 is not connected directly to fan 3, but is coupled to fan 3 through a fan switch 62. Specifically, contact 613 is connected to contact 621 of FAN switch 62. FAN switch 62 has a High Speed contact 622 and a Low Speed contact 623. Contacts 622 and 623 are connected appropriately to fan 3. As can be seen in FIG. 5, regardless of the manner in which switch 62 is engaged, as long as switch 62 is engaged in the "fan ON" position, smoke detector 4 will be disabled or inhibited.

The primary advantages of the subject invention are deemed apparent from the above Description. It is worth emphasizing, however, that the invention operates to virtually instantaneously interrupt the detector's audible alarm when an individual engages a switch, such as switch 61, in a predetermined position according to which the exhaust fan is caused to operate. In the conventional situation, the smoke detector is not coupled to the fan or the stove hood. As a result, the audible alarm ceases only when the fan has removed sufficient smoke to release the alarm.

In the corresponding mode of operation contemplated by this invention, the smoke detector is (electrically) coupled to the stove hood, that is, to switch 6, via conductor 5. The smoke detector would be initially enable by installing the smoke detector in proximity with the stove and by applying the power source, through switch 61, to the smoke detector. The occurrence of smoke causes the smoke alarm to be sounded and observed by the individuals attending the stove. When that individual responds by enabling the exhaust fan, the smoke detector alarm is automatically and substantially simultaneously caused to cease.

Accordingly, although there has been disclosed and described what at present is deemed to be a preferred embodiment of a Selectively Engageable Smoke Alarm, it will be obvious to those having ordinary skill in the art that various modifications can be made to the embodiments of the invention described herein, without departure from the scope of the appended claims.

I claim:

1. An apparatus for selectively disabling a smoke detector alarm in proximity with a smoke-generating device, the apparatus comprising:

smoke detector means for generating an alarm in response to the detection of smoke; and switch means electronically coupled to the smoke-generating device and also coupled to the smoke detector means for enabling the smoke detector means when said switch means is engaged in a first position and for disabling the smoke detector means when said switch means is engaged in a second position, the smoke-generating device is a cooking device that includes a fan and the switch means is electronically coupled to the smoke-generating device to turn the fan ON and OFF such that when the fan is ON the smoke detector means is disabled and when the fan is OFF the smoke detector means is enabled.

2. An apparatus as defined in claim 1 wherein the smoke detector means is located in proximity with the cooking device.

3. An apparatus as defined in claim 2 wherein engagement of the switch means in the first position in indicative of an OFF condition of the cooking device and engagement of the switch means in the second position is indicative of an ON condition of the cooking device so that the smoke detector means is enabled when the cooking device is in the OFF condition and is disabled when the cooking device is in the ON condition.

4. An apparatus for selectively disabling a smoke detector alarm in proximity with a smoke-evacuating device, the apparatus comprising:

smoke detector means for generating an alarm in response to the detection of smoke; and switch means electronically coupled to the smoke-evacuating device and also coupled to the smoke detector means for enabling the smoke detector means when said switch means is engaged in a first position and for disabling the smoke detector means when said switch means is engaged in a second position, the smoke-evacuating device is an exhaust fan device and wherein the smoke-detector means is located in proximity with the exhaust fan device, engagement of the switch means in the first position is indicative of an OFF condition of the exhaust fan device and engagement of the switch means in the second position is indicative of an ON condition of the exhaust fan device so that the smoke detector means is enabled when the exhaust fan device is in the OFF condition and is disabled when the exhaust fan device is in the ON condition.

5. A method for selectively disabling a smoke detector alarm in proximity with a smoke-generating device, comprising the steps of:

providing smoke detector means for generating an alarm in response to the detection of smoke; and providing switch means electronically coupled to the smoke-generating device and also coupled to the smoke detector means for enabling the smoke detector means when said switch means is engaged in a first position and for disabling the smoke detector means when said switch means is engaged in a second position, the smoke-generating device is a cooking device that includes a fan and the switch means is electronically coupled to the smoke-generating device to turn the fan ON and OFF such that when the fan is ON the smoke detector means is disabled and when the fan is OFF the smoke detector means is enabled.

6. A method as defined in claim 5 wherein the smoke detector means is located in proximity with the cooking device.

7. A method as defined in claim 6 wherein engagement of the switch means in the first position is indicative of an OFF condition of the cooking device and engagement of the switch means in the second position is indicative of an ON condition of the cooking device so that the smoke detector means is enabled when the cooking device is in the OFF condition and is disabled when the cooking device is in the ON condition.

8. A method for selectively disabling a smoke detector alarm in proximity with a smoke-evacuating device, the method comprising the steps of:

providing smoke detector means for generating an alarm in response to the detection of smoke; and providing switch means electronically coupled to the smoke-evacuating device and also coupled to the smoke detector means for enabling the smoke detector means when said switch means is engaged in a first position and for disabling the smoke detector means when said switch means is engaged in a second position, the smoke-evacuating device is an exhaust fan device and wherein the smoke detector means is located in proximity with the exhaust fan device, engagement of the switch means in the first position is indicative of an OFF condition of the exhaust fan device and engagement of the switch means in the second position is indicative of an ON condition of the exhaust fan device so that the smoke detector means is enabled when the exhaust fan device is in the OFF condition and is disabled when the exhaust fan device is in the ON condition.

* * * * *